United States Patent [19]

Ferree

[11] 4,214,420

[45] Jul. 29, 1980

[54] HARNESS DEVICE

[76] Inventor: Kenneth B. Ferree, 542 W. California St., Ontario, Calif. 91761

[21] Appl. No.: 800,397

[22] Filed: May 25, 1977

[51] Int. Cl.[2] ..... B68B 1/00

[52] U.S. Cl. ..... 54/35; 54/16; 54/71; 54/57

[58] Field of Search ..... 54/6 A, 4, 12, 13, 14, 54/16, 24, 35, 36, 57, 70, 71

[56] References Cited

U.S. PATENT DOCUMENTS

| | | | |
|---|---|---|---|
| 384,460 | 6/1888 | Miller | 54/13 |
| 531,753 | 1/1895 | Smith | 54/36 X |
| 1,030,022 | 6/1912 | Shank | 54/16 |
| 1,048,501 | 12/1912 | Dawson | 54/35 |
| 3,906,707 | 9/1975 | Morgan | 54/35 |

FOREIGN PATENT DOCUMENTS

| | | | |
|---|---|---|---|
| 2328294 | 12/1974 | Fed. Rep. of Germany | 54/16 |

*Primary Examiner*—Louis G. Mancene
*Assistant Examiner*—Robert P. Swiatek
*Attorney, Agent, or Firm*—Neil F. Markva

[57] ABSTRACT

The harness device is used to effect head control of a horse and includes a crown assembly connected to a bit in the horse's mouth via a pair of control lines connectable to a strap that is attached either along the belly or the mane of the horse. The crown assembly is effective to fit over the ears of a horse and includes a poll strap extending across the poll area of the horse's head. The strap is detachably connectable to the cinch of a saddle for extending forward along the horse's belly between the front legs of the horse. The pair of control lines extends from the end of the belly strap to the bit via a movable connection with the crown assembly. This controls the upward movement of the head. A pair of control lines attached to a strap extending along the horse's mane controls the downward movement of the head.

6 Claims, 7 Drawing Figures

Fig. 3
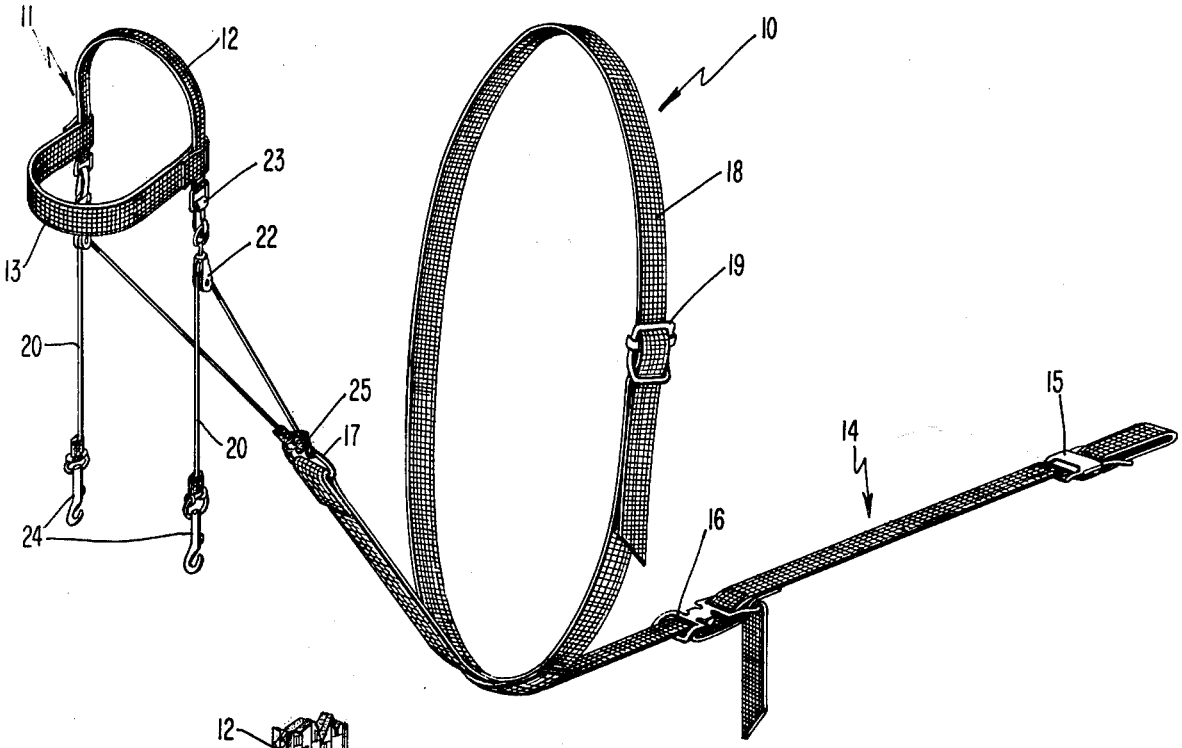
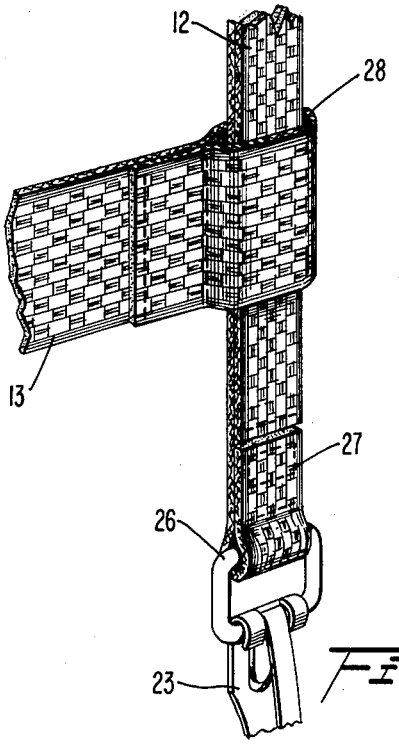
Fig. 5
Fig. 4
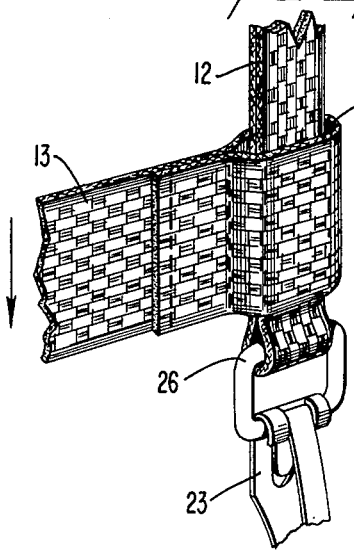

HARNESS DEVICE

BACKGROUND OF THE INVENTION

This invention relates to a device for controlling the head movement of a horse. More particularly, it is directed to the use of a harness device connected to a martingale strap and the bit in the horse's mouth.

Control harness devices useful for horses are well known. Most of these prior art devices are attachable to the bit in the horse's mouth. This type of device is generically referred to as a martingale. Such prior art devices are useful for preventing the horse from raising his head above a predetermined position. At the same time, free movement of the head from side to side is desired to enable the horse to change direction rapidly even while moving at considerable speed.

Many horses are difficult to control when riding because there is a tendency to excessively raise the head or throw the head excessively forward. There are problems of rearing, flipping, running off, head throwing and bad acting, in general, which must be overcome in order for a horse to be properly trained. Most all of the prior art devices designed to effect head control operate primarily only on the bit or completely separate therefrom.

PURPOSE OF THE INVENTION

The primary object of this invention is to provide a simple harness device which may be used in combination with the conventional bridle for the purpose of effecting head control of a horse.

Another object of this invention is to provide a device which will provide pressure on the poll area of the head in addition to the bit in the horse's mouth for the purpose of teaching a horse to have complete respect for the rider or handler.

A further object of this invention is to provide a harness device which constitutes an improvement over the well known prior art martingale structures in that the total control is not limited to operation of the bit in the horse's mouth.

A still further object is to provide a harness device that may be used to control either the upward or downward head movement of a horse, or both at the same time.

SUMMARY OF THE INVENTION

These objects and other advantages will be accomplished through the use of the device as disclosed and described herein. The device comprises a crown assembly effective to fit over the ears of the horse. The crown assembly includes a poll strap extending across the poll area of the head which is the area immediately behind the horse's ears. A pair of control lines are attachable at one end thereof to a bit in the horse's mouth and at the other end thereof to a strap means that is detachably connectable to extend along either the belly or mane of a horse. When the strap means extends from the cinch of the saddle forwardly along the belly between the front legs of the horse, the upward movement of the horse's head is controlled. The control lines are each movably connected at an intermediate point between their ends to the crown assembly. The movable connection is established at the ends of the poll strap.

In a specific embodiment of the invention, pulley means is connected to the crown assembly at each end of the poll strap. Each of the control lines is threaded through the pulley means to effect the movable connection with the crown assembly. Further, an adjustable neck strap means is connected to an intermediate point between the ends of the strap extending from the cinch along the belly through the front legs of the horse.

In another embodiment, a strap means extends along the horse's mane and connects to the saddle in any desired manner. Each of the control lines is threaded through the pulley means as in the first embodiment. In this instance, the downward movement of the horse's head causes a pressure on the poll area of the head and the bit.

The user of the disclosed device may control either one or both of the horse's head movements as desired.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 3 is a perspective view of the device shown in FIG. 1 by itself;

FIG. 4 is a fragmentary perspective view showing the end construction of a poll strap on a crown assembly made in accordance with this invention;

FIG. 5 is a fragmentary perspective view of the connection between the forehead strap and the poll strap as shown in FIG. 4;

DESCRIPTION OF SPECIFIC EMBODIMENTS

Figure 1:
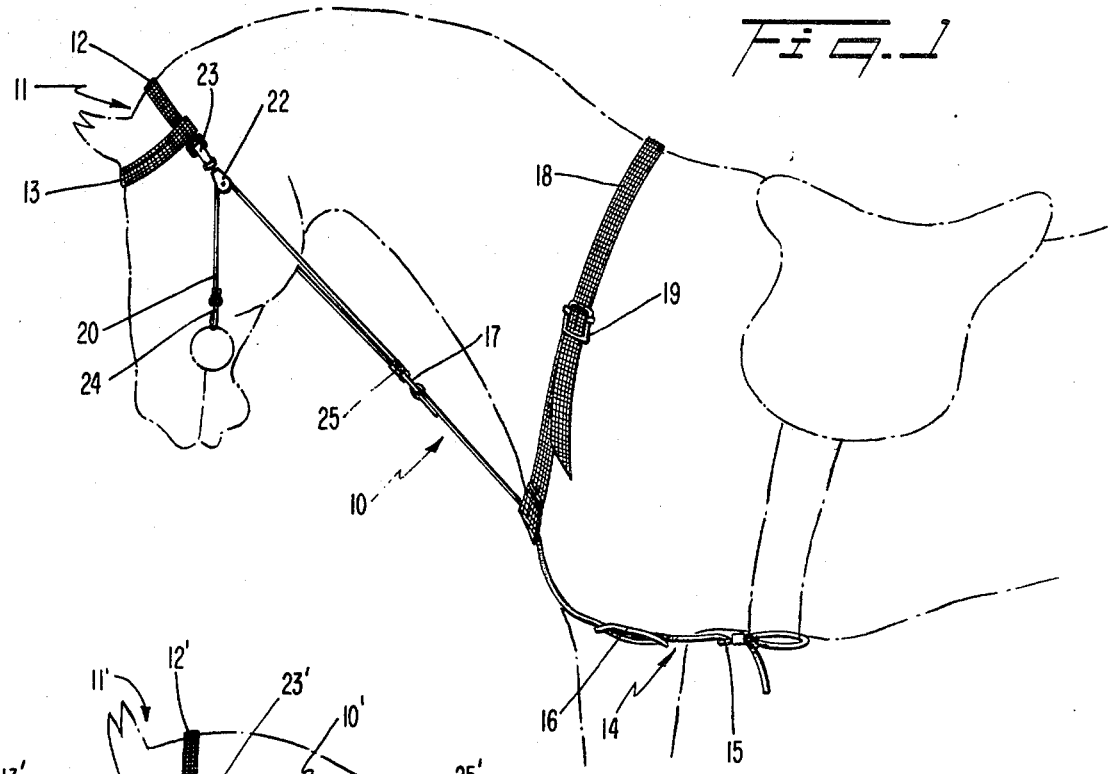
FIG. 1 is a perspective view of the device made in accordance with this invention as shown applied for controlling the upward head movement of a horse.

More specifically, referring to FIG. 1, the device, generally designated 10, includes a crown control assembly 11 that is movably connected to ring 17 of martingale strap 14 via lines 20. Strap 14 is connected at the other end to a saddle cinch strap as shown. A neck strap 18 is adjustably disposed around the neck of the horse and connected intermediate the ends of the strap 14. Buckle 19 is used to give adjustability to the neck strap 18. The buckle 15 at one end of the strap 14 enables the device to be tightened to the saddle cinch strap. The length of the strap 14 is also adjustable by way of the buckle 16.

The crown assembly 11 includes a poll strap 12 and a forehead or brow band 13. Crown assembly 11 fits over the ears of the horse with the poll strap 12 extending over the poll area of the head behind the ears. A pulley 22 is snap connected to each end of the poll strap 12 as shown. A fastening member 23 is connected in a loop 26 at each end of the poll strap 12. The ends of the poll strap 12 are doubled back to form a double portion 27 and the loop 26 as shown clearly in FIG. 5. The ends of the brow band 13 have a loop 28 which is slidable along the length of the poll strap 12. This may be placed over the double portion 27 to enhance the fitting of the crown assembly 11 over the ears of the horse.

Figures 6, 7:
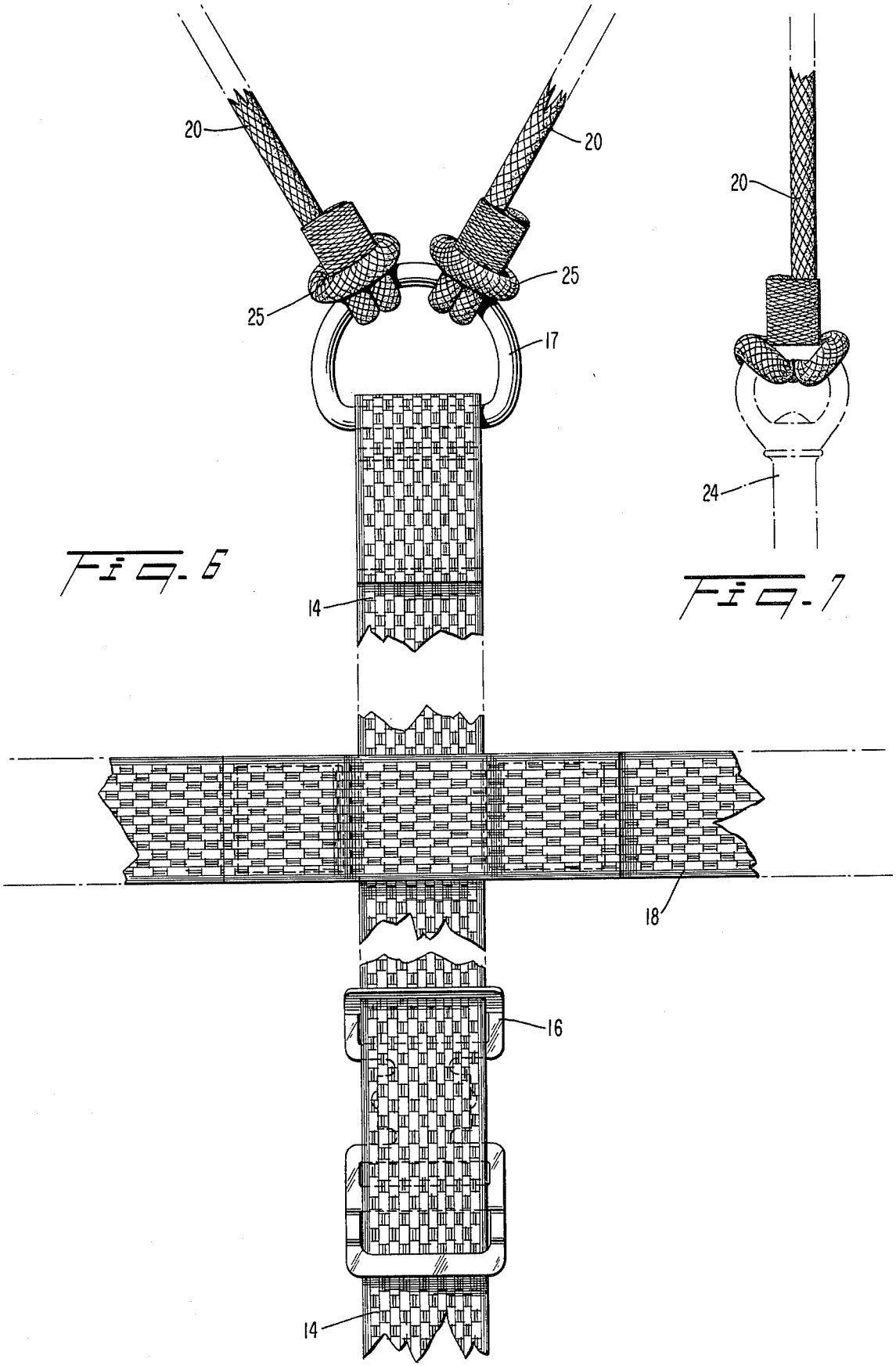
FIG. 6 is a fragmentary elevational view showing a device made in accordance with this invention.
FIG. 7 is a detail, fragmentary view of a control line made in accordance with this invention.

A pair of control lines 20 are connected to the ring 17 via knots 25 as shown. The ring 17 is fixed to the end of the martingale strap 14. Clips or fasteners 24 are attached to the other ends of the control lines 20 as shown. Fasteners 24 are connected to the end of the bit in the horse's mouth as shown in FIG. 1. The details of connecting the knots 25 to ring 17 and the line 20 to the fasteners 24 are shown in FIGS. 6 and 7, respectively. The control lines 20 are composed of nylon cords. The other strap members are made of woven nylon with the loops being sewed in place once the ends of the nylon straps are doubled back upon themselves. The specific position of the neck band or strap 18 may be changeable due to the sliding relationship between the neckstrap and the martingale strap 14 as shown in FIG. 6. As is evident in the drawings, control lines 20 are directly connected between ring 17 of strap 14 and the ends of the bit as shown. The only intermediate attachment is at the poll strap pulleys 22.

Figure 2:
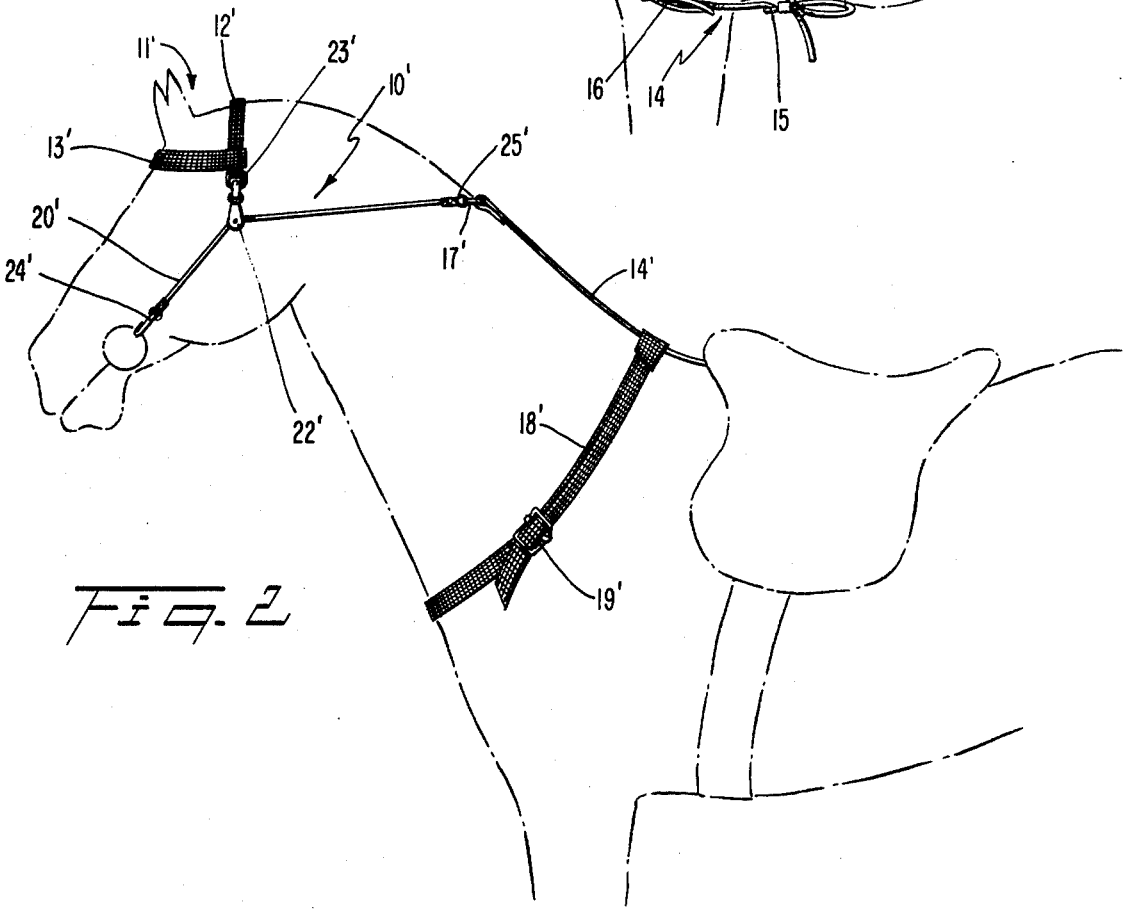
FIG. 2 is a perspective view of a device made in accordance with this invention as shown applied for controlling the downward head movement of a horse.

The method of using the device 10' of the invention to maintain the horse's head at a preselected height is shown in FIG. 2. The crown assembly 11' is movably connected via control lines 20' to the ring 17' of strap 14' which is disposed along the horse's mane as shown. The strap 14' is connected to the neck strap 18' which is adjustable via buckle 19'. The strap 14' is connected at the other end thereof in any desired fashion such as behind the stirrup leathers on an English saddle.

When two devices 10 and 10' are used, only one neck strap 18 would be used. The neck strap 18' could be used to connect the upper device 10' to the saddle as noted. For example, the neck strap 18' would be run through the loop on the belly strap through which the horse's girth normally is disposed. The tension is then adjusted to keep the horse's head at any desired height. Both sets of control lines 20 and 20' may extend through pulleys 22. It may also be possible to have a separate set of pulleys to operate with each set of control lines 20 and 20'.

In operation, the horse is first placed in a small area to confine his movement. Before removing the halter from the horse, the neckstrap is placed over the horse's head in the fastened position. The halter is then removed and the crown assembly 11 placed over the horse's ears. The bridle is then placed on the horse and the fasteners 24 are then snapped on each side of the bit. The saddle is placed on the horse's back with the girth run through the belly, or martingale, strap 14 and connected via buckle 15. The chest adjustment strap or martingale strap 14 is then adjusted in length with buckle 16 so that there is some pressure on the poll area by the poll strap 12.

The amount of pull is adjustable in accordance with the specific circumstances of the horse's condition. The amount of pressure should be enough on the poll area and on the mouth via the pressure on the bit to get the horse's respect for harness device 10. However, the pressure must not be too severe to frighten the horse. If the horse rears up, the tendency is for the head to be thrown backwardly. This causes lines 20 to pull upwardly on the bit and downwardly on the poll strap 12. Thus, the horse learns that he will receive a painful pressure across the poll area when he rears upwardly or throws his head backwardly or holds the neck and head in an improper position.

When the harness device 10 is used, as shown in FIG. 1, the horse is taught to have his chin tucked in and his neck arched. The tucking in of the head will relieve any pressure on the mouth since the control lines 20 will become slack when connected to the martingale strap 14. With crown assembly 11 the horse will receive pressure on the poll area behind the ears when he throws his head backwardly or rears up. On the other hand, when the device 10' is used as shown in FIG. 2, the poll area receives pressure when the horse does not hold his head at the desired height. Thus, it is possible to set limits on the horse in either direction if two devices are used on the horse simultaneously.

While the harness device has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A harness device used in combination with a conventional bridle for effecting head control of a horse, said harness device comprising:

(a) strap means having two ends with a first end thereof being attachable to a saddle means, said strap means being adapted to function in a dual mode whereby it extends forward from the saddle means between the front legs when controlling the upward head movement of a horse and extends along the mane of the horse when controlling the downward head movement of a horse, (b) a neck strap means connected to the strap means intermediate the ends of the strap means and being effective to encircle the neck of the horse, (c) a crown assembly effective to fit over the ears of the horse, (d) said crown assembly including a poll strap extending across the poll area of the head, (e) pulley means connected to the crown assembly at each end of the poll strap, and (f) a plurality of control lines adapted for attachment at one end thereof to an end of a bit in the horse's mouth and at the other end thereof to the other end of the strap means, (g) each said control line extending through a respective one of the pulley means.

2. A device as defined in claim 1 wherein the crown assembly includes a forehead strap effective to fit in front of the horse's ears, said forehead strap being connected at each end thereof to a respective end of the poll strap.

3. A device as defined in claim 2 wherein each said forehead strap end has a loop slidably disposed on said poll strap.

4. A device as defined in claim 3 wherein each end of the poll strap is folded back to form a loop end doubled portion, said forehead strap end loop is slidable over said double portion.

5. A device as defined in claim 1 wherein said strap means includes a ring member to which said control lines are connected with a knot.

6. A device as defined in claim 1 wherein said strap means is adjustable with respect to length.

* * * * *